US005779489A

United States Patent [19]

Davis et al.

[11] Patent Number: 5,779,489

[45] Date of Patent: Jul. 14, 1998

[54] BOARD MOUNTABLE ELECTRICAL CONNECTOR

[75] Inventors: Wayne Samuel Davis, Harrisburg; Michael Eugene Shirk, Grantville; Robert Neil Whiteman, Jr., Middletown, all of Pa.

[73] Assignee: The Whitaker Corporation, Wilmington, Del.

[21] Appl. No.: 738,159

[22] Filed: Oct. 25, 1996

Related U.S. Application Data

[63] Continuation-in-part of Ser. No. 705,932, Aug. 30, 1996, Pat. No. 5,725,386, which is a continuation-in-part of Ser. No. 653,144, May 24, 1996, abandoned.

[51] Int. Cl.[6] ..... H01R 9/09

[52] U.S. Cl. ..... 439/79

[58] Field of Search ..... 439/79, 80

[56] References Cited

U.S. PATENT DOCUMENTS

| | | | |
|---|---|---|---|
| 4,210,376 | 7/1980 | Hughes et al. . | |
| 4,225,209 | 9/1980 | Hughes | 439/676 |
| 4,410,230 | 10/1983 | SanMiguel . | |
| 4,425,015 | 1/1984 | Rizzo . | |
| 4,550,962 | 11/1985 | Czeschka . | |
| 4,639,056 | 1/1987 | Lindeman et al. . | |
| 4,660,911 | 4/1987 | Reynolds et al. | 439/80 |
| 4,715,820 | 12/1987 | Andrews, Jr. et al. | 439/59 |
| 4,802,860 | 2/1989 | Kikuta | 439/79 |
| 4,815,982 | 3/1989 | Sadigh-Behzadi | 439/82 |
| 4,842,528 | 6/1989 | Frantz | 439/80 |
| 4,995,819 | 2/1991 | Ohl | 439/79 |
| 5,037,334 | 8/1991 | Viselli et al. | 439/733 |
| 5,071,372 | 12/1991 | Viselli et al. | 439/733 |
| 5,080,596 | 1/1992 | Viselli et al. | 439/79 |
| 5,085,601 | 2/1992 | Buchter et al. | 439/660 |
| 5,096,428 | 3/1992 | Lwee et al. | 439/79 |
| 5,122,078 | 6/1992 | Davis et al. | 439/405 |
| 5,145,383 | 9/1992 | Bowen et al. | 439/78 |
| 5,199,886 | 4/1993 | Patterson | 439/79 |
| 5,266,038 | 11/1993 | Nakamura | 439/79 |
| 5,316,489 | 5/1994 | Kachlic et al. | 439/79 |
| 5,478,261 | 12/1995 | Bogese, II | 439/79 |

FOREIGN PATENT DOCUMENTS

| | | |
|---|---|---|
| 0 385 577 | 9/1990 | European Pat. Off. . |
| 7-272803 | 3/1994 | Japan . |

*Primary Examiner*—Neil Abrams
*Attorney, Agent, or Firm*—Anton P. Ness

[57] ABSTRACT

An electrical connector (10) having a housing (12) and contact members (16) having vertical sections (36) extending along slots (42) of a rear housing face (24) and concluding in horizontal feet (40) adapted for surface mounting to a circuit board. Positioning recesses (60) receive flanges (62) of vertical contact sections (36) in a snug fit assuredly holding feet (40) along board-mounting face (26) facilitating surface mounting. A rib (64) is defined in each recess (60) to be deformed by a surface (66) of its associated flange (62) during insertion to anchor the flanges in the recesses.

4 Claims, 2 Drawing Sheets

BOARD MOUNTABLE ELECTRICAL CONNECTOR

RELATED APPLICATION INFORMATION

This is a Continuation-in-Part of U.S. patent application Ser. No. 08/705,932 filed Aug. 30, 1996, now U.S. Pat. No. 5,725,386, in turn a Continuation-in-Part of Ser. No. 08/653,144 filed May 24, 1996, now abandoned.

FIELD OF THE INVENTION

This relates to the field of electrical connectors and more particularly to connectors mounted onto circuit boards.

BACKGROUND OF THE INVENTION

Certain electrical connectors are known that are mountable onto a surface of a circuit board at a board-mounting face for electrical interconnection of contacts with board circuits, and define a mating face for mating and electrical interconnection with a complementary electrical connector. In U.S. Pat. Nos. 4,842,528; 5,071,372 and 5,080,596 are disclosed connectors each having an array of contacts extending from contact sections exposed at the mating face about right angles to tails depending from the board-mounting face, for insertion of tails of the contacts into through-holes of the circuit board for eventual soldering to define the electrical interconnections to the board circuits. Along the board-mounting face, a spacer plate extends rearwardly from the housing body to a rear edge, and grooves extend forwardly in the plate from the rear edge. The vertical portion of each contact includes a plate retention section to be disposed in the groove, with widened protrusions just above and just below the plate retention section serving to limit upward and downward movement thereof relative to the plate.

It is desired to provide a connector for right-angle board mounting wherein the contact tails are positively retained precisely in position by the housing to facilitate board mounting.

It is further desired to provide such a connector especially suitable for maintaining feet of contact tails precisely in position in a coplanar array for surface mounting.

SUMMARY OF THE INVENTION

The connector of the present invention provides a housing with a rear face containing vertical slots for respective vertical contact sections upon assembly of the contacts into the housing from the rear face. Along facing side surfaces of the slots are defined opposed recesses wherein are disposed widened contact portions or flanges along the vertical contact sections trapped to prevent relative upward or downward contact movement, so that the horizontal feet at ends of the vertical sections are held coplanar along the board-mounting face to facilitate surface mount board mounting.

An embodiment of the invention will now be described by way of example with reference to the accompanying drawings.

DETAILED DESCRIPTION

Figure 1:
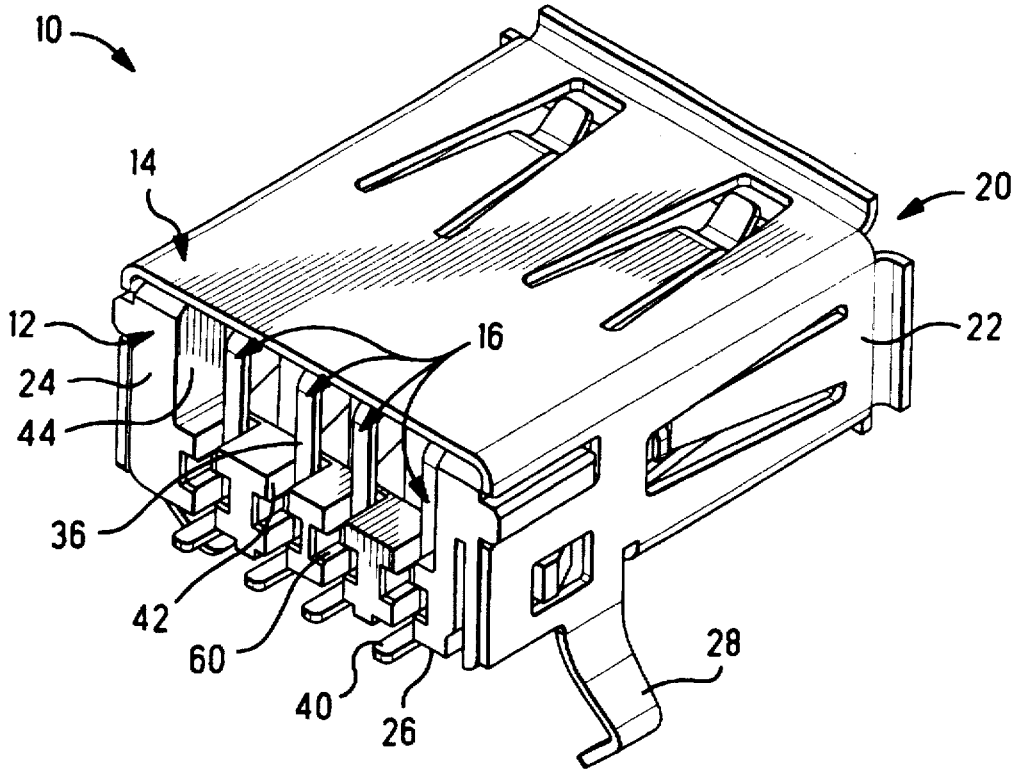
FIGS. 1 and 2 are rear isometric and elevation views of the connector of the present invention.
Figure 2:
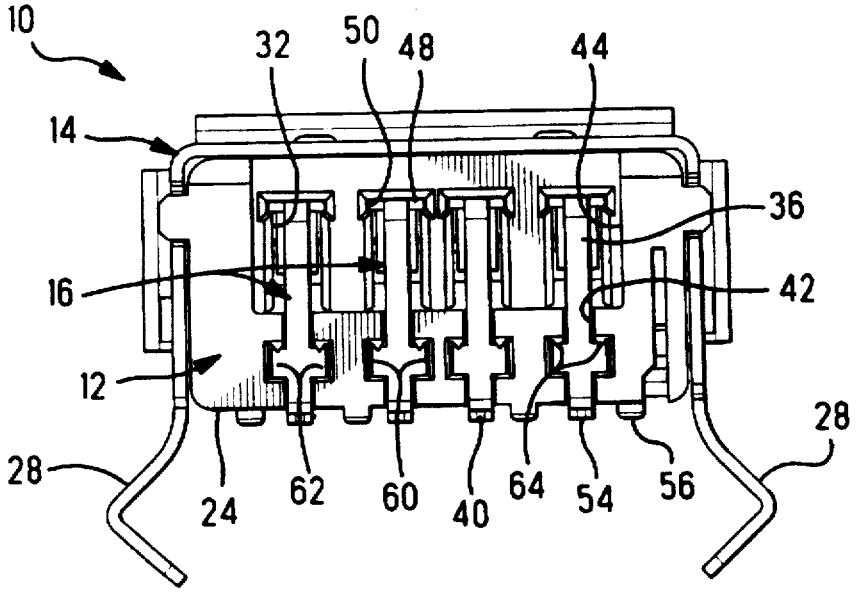
Figure 4:
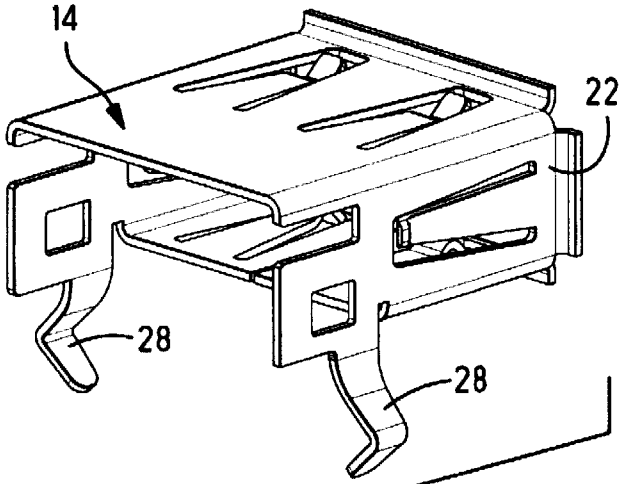
FIG. 4 is an enlarged view of a portion of the connector of FIG. 3 illustrating a contact poised for insertion into the housing.
Figure 4:
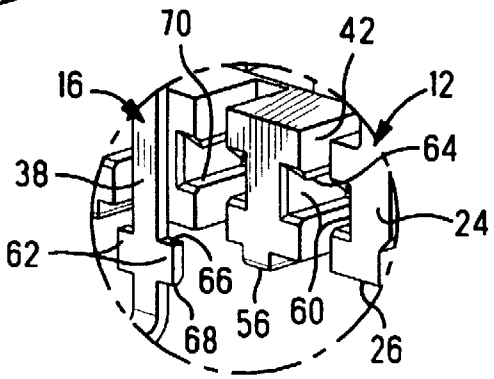
Figure 3:
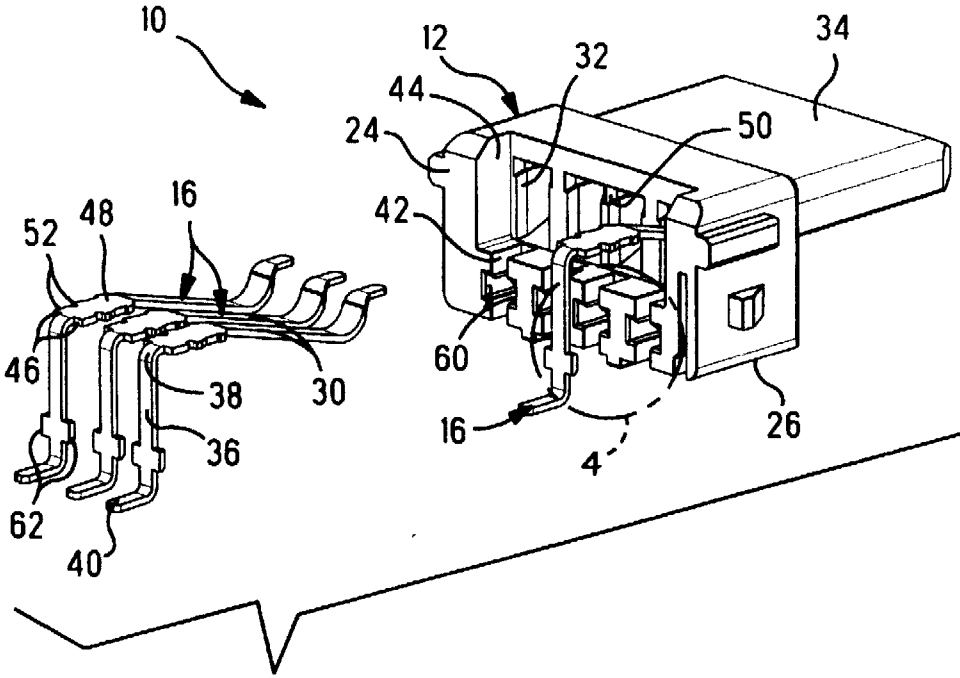
FIG. 3 is an exploded isometric view of the connector of FIGS. 1 and 2.

Connector 10 includes a housing 12 of insulative material, a shield member 14 therearound, and a plurality of contacts 16 contained in the connector. The connector is similar to that disclosed in U.S. patent application Ser. No. 08/653,144 filed May 24, 1996 in having an array of for example four contacts with horizontal contact sections disposed along a support wall within a plug-receiving cavity, the contact sections being spring arms deflectable laterally into channels of the support wall upon mating. In Ser. No. 08/653,144, as well as in U.S. Pat. No. 4,210,376, vertical contact sections depend below the board-mounting face for board through-hole insertion, and retention barbs are defined therealong for interference fit in vertical slots of the housing.

Housing 12 extends from a mating face 20 enshrouded by forward shield section 22, to an opposed rear or assembly face 24, with a board-mounting face 26 shown along the bottom extending from front to rear. Shield 14 includes a pair of board-mount legs 28 receivable into mounting holes of the circuit board (not shown), as is conventional. Contact sections 30 of contacts 16 extend through passageways 32 of housing 12 to be disposed along support wall 34 and thereby be exposed at mating face 20 for mating with complementary contacts of a mating connector (not shown). Vertical contact sections 36 depend from right-angle bends 38 along rear face 24 of housing 12 to conclude in horizontal feet 40 parallel to board-mounting face 26 that are adapted to be soldered to circuit pads along a surface of a circuit board (not shown). Slots 42 are defined along rear housing face 24 within which extend vertical contact sections 36.

A clearance 44 is formed in rear housing face 24 to permit insertion of contacts 16 from the rear, such that push tooling (not shown) may engage push surfaces 46 of contacts 16 for full insertion of contact body sections 48 into passageways 32; contact body sections 48 are seen to be received into widened slot portions 50 of passageways 32 to assure accurate vertical positioning of contact sections 30, and barbs 52 of body sections 48 create an interference fit in slot portions 50 for retention of the contacts 16 in housing 12.

In accordance with the present invention, connector 10 is adapted to provide assurance that feet 40 of contacts 16 are maintained precisely coplanar with their bottom surfaces 54 coplanar with bottom surfaces of standoffs 56 along board-mounting face 26. Spaced just upwardly from board-mounting face 26 along rear housing face 24 are defined positioning recesses 60 along opposed sides of vertical slots 42. Associated with positioning recesses 60 are flanges 62 extending laterally from side edges of vertical contact sections 36 located just upwardly from feet 40, with the dimensions of flanges 62 and recesses 60 selected to provide at least a snug fit to stabilize the positions of the lower ends of vertical contact sections 36.

Preferably, a sharp or V-shaped rib 64 is defined along each positioning recess 60 extending vertically into the flange-receiving clearance of the recess (shown along the top of recess 60), necessitating that upon engagement with the associated surface 66 of the adjacent flange 62, the rib will be deformed upon full contact insertion thus forming an interference fit to anchor the flange in the positioning recess. Preferably, the forward edge of flange surface 68 opposite the rib-corresponding surface 66 is chamfered to facilitate entry of the flange into the recess during contact insertion and urging the corresponding flange surface 66 against and into rib 64, with opposed flange surface 68 thus maintained firmly against reference surface 70 of recess 60 precisely located with respect to bottom surfaces of standoffs 56.

Further, it is preferred that the dimensions between flange surface 68 and bottom foot surface 54, and between reference recess surface 70 and the standoff bottom surfaces, both be controlled to a tolerance of about ±0.001 inches, for a maximum combined tolerance of about ±0.002 inches.

Variations and modifications to the specific embodiment disclosed herein, may occur that are within the spirit of the invention and the scope of the claims.

What is claimed is:

1. An electrical connector of the type suitable for mounting to a surface of a circuit board, comprising:

a housing of insulative material having a board-mounting face, a mating face and an assembly face opposed to said mating face; and at least one contact member having a contact section exposed along said mating face, and a second section extending along said assembly face to a board-connecting section for connection to a circuit of a circuit board at said board-mounting face, said assembly face including a slot therealong parallel to said second section with said second section disposed therealong, at least one flange-receiving recess defined into a side wall of said slot, and said second section including a flange associated with each said at least one recess and extending laterally from an edge of said second contact section, said flange being received into said flange-receiving recess in a snug fit allowing essentially no movement of said second section along said assembly face perpendicular to said board-mounting face; and a surface of said at least one recess parallel to said board-mounting face including a sharp rib extending into said recess, and said associated flange of said second contact section is assuredly urged against an opposed recess surface referenced to bottom standoff surfaces of the housing while deforming said rib during assembly, whereby said board-connecting section of said contact is assuredly held in position with respect to said board-mounting face.

2. The electrical connector as set forth in claim 1 wherein said slot includes a second said recess opposed from said at least one said recess, and said second contact section includes a corresponding second said flange.

3. The electrical connector as set forth in claim 1 wherein said board-connecting section extends parallel to said board-mounting face, for surface mounting to a circuit board.

4. The electrical connector as set forth in claim 1 including a plurality of said contact members.

* * * * *